US005949460A

United States Patent [19]

Ahn

[11] Patent Number: 5,949,460

[45] Date of Patent: Sep. 7, 1999

[54] INK RESERVOIR FOR INKJET PRINT HEAD

[75] Inventor: Byung-Sun Ahn, Kyungki-do, Rep. of Korea

[73] Assignee: SamSung Electronics Co., Ltd., Kyundki-do, Rep. of Korea

[21] Appl. No.: 09/019,124

[22] Filed: Feb. 5, 1998

[30] Foreign Application Priority Data

Feb. 5, 1997 [KR] Rep. of Korea ..... 97/03444

[51] Int. Cl.[6] ..... B41J 2/175

[52] U.S. Cl. ..... 347/86

[58] Field of Search ..... 347/84, 85, 86, 347/87

[56] References Cited

U.S. PATENT DOCUMENTS

| | | | |
|---|---|---|---|
| 4,025,928 | 5/1977 | Hou et al. . | |
| 4,119,034 | 10/1978 | Wax . | |
| 4,424,521 | 1/1984 | Lewis et al. . | |
| 4,509,062 | 4/1985 | Low et al. . | |
| 4,511,906 | 4/1985 | Hara . | |
| 4,513,297 | 4/1985 | Okamura . | |
| 4,580,147 | 4/1986 | Deyoung et al. . | |
| 4,739,347 | 4/1988 | Ishikawa et al. . | |
| 4,791,439 | 12/1988 | Guiles . | |
| 4,824,487 | 4/1989 | Heffernan . | |
| 4,899,178 | 2/1990 | Teiller . | |
| 4,914,453 | 4/1990 | Kanayama et al. . | |
| 4,929,963 | 5/1990 | Balazer . | |
| 4,937,598 | 6/1990 | Hine et al. . | |
| 5,121,132 | 6/1992 | Pan et al. . | |
| 5,223,860 | 6/1993 | Loofbourow et al. . | |
| 5,233,369 | 8/1993 | Carlotta et al. . | |
| 5,278,584 | 1/1994 | Keefe et al. . | |
| 5,420,625 | 5/1995 | Dietl et al. . | |
| 5,440,333 | 8/1995 | Sykora et al. . | |
| 5,450,112 | 9/1995 | Scheffelin . | |
| 5,459,497 | 10/1995 | Manning et al. . | |
| 5,464,578 | 11/1995 | Salter et al. . | |
| 5,479,968 | 1/1996 | Sanchez et al. | 141/110 |
| 5,486,855 | 1/1996 | Carlotta et al. . | |
| 5,552,816 | 9/1996 | Oda et al. | 347/86 |
| 5,590,510 | 1/1997 | Mochizuki et al. . | |
| 5,646,666 | 7/1997 | Cowger et al. . | |
| 5,650,811 | 7/1997 | Seecombe et al. . | |
| 5,663,753 | 9/1997 | Story et al. . | |
| 5,684,521 | 11/1997 | Salter et al. . | |
| 5,686,947 | 11/1997 | Murray et al. . | |
| 5,709,253 | 1/1998 | Maerzke . | |
| 5,796,419 | 8/1998 | Clark et al. | 347/85 |
| 5,812,155 | 9/1998 | Seccombe | 347/6 |

FOREIGN PATENT DOCUMENTS

| | | |
|---|---|---|
| 08132633 | 5/1996 | Japan . |

*Primary Examiner*—N. Le
*Assistant Examiner*—Michael Nghiem
*Attorney, Agent, or Firm*—Robert E. Bushnell, Esq.

[57] ABSTRACT

An ink reservoir for an inkjet print head includes a housing for storing ink, a plurality of elastic pieces mounted on the top and bottom of the housing for absorbing air or ink, a plurality of supporting plates for supporting and maintaining the shape of the elastic pieces, and an elastic member attached to the supporting plates for keeping the elastic pieces spaced apart by a predetermined height. Preferably, the elastic member comprises first and second supporting rods which are telescopically joined, and a compression spring is inserted into one of the supporting rods for resiliently supporting the other supporting rod.

30 Claims, 5 Drawing Sheets

INK RESERVOIR FOR INKJET PRINT HEAD

CLAIM OF PRIORITY

This application makes reference to, incorporates the same herein, and claims all benefits accruing under 35 U.S.C. §119 from my application Entitled Ink Reservoir for Inkjet Print Head earlier filed in the Korean Industrial Property Office on the 5th day of Feb. 1997, and there duly assigned Ser. No. 97-3444 by that office.

BACKGROUND OF THE INVENTION

1. Technical Field

The present invention relates to an ink reservoir for an inkjet print head, and more particularly to an inkjet print head for regulating the internal pressure in its housing in order to reduce the amount of ink remaining and thereby enhance efficiency in ink storage.

2. Related Art

An inkjet print head includes a housing for storing ink, and an ink spraying device for spouting the ink contained in the housing when electric energy is applied thereto. The housing supplies ink by producing an internal pressure for offering ink to the ink spraying device. When the amount of ink in the housing decreases, an air bag expands proportionally. With the air bag increasing, the ink stored in the housing receives a predetermined pressure.

As a result of this pressure, the ink is supplied to the ink spraying device. The ink offered to the ink spraying device is spouted and prints when electric energy is applied. As such procedure is repeated, the ink supply becomes gradually exhausted as a result of ink being sent to the ink spraying device from the housing. Upon consumption of the ink, the air bag expands within a predetermined limit. The air bag is made to expand in proportion to the ink storage capacity of the housing. As a result, the pressure generated by the air bag has a limit so that a predetermined amount of ink is left in the housing. For this reason, there is required an inkjet print head for regulating the internal pressure in the housing to thereby reduce the amount of ink remaining after exhaustion or full consumption of the ink supply.

The following patents are considered to be representative of the prior art relative to this invention, but are burdened by the disadvantages discussed herein: U.S. Pat. No. 5,709,253 to Maerzke entitled a Method For Refilling An Inkjet Cartridge And Apparatus To Modify A Cartridge With A Negative Pressure Reservoir, U.S. Pat. No. 5,686,947 to Murray et al. entitled an Ink Jet Printer Incorporating High Volume Ink Reservoirs, U.S. Pat. No. 5,684,521 to Salter et al. entitled a Compact Fluid Coupler For Thermal Inkjet Printer Cartridge Ink Reservoir, U.S. Pat. No. 5,663,753 to Story et al entitled a Recording Cartridge With Replaceable Liquid-Containing Reservoir, U.S. Pat. No. 5,650,811 to Seccombe et al. entitled an Apparatus For Providing Ink To A Printhead, U.S. Pat. No. 5,646,666 to Cowger et al. entitled a Back Pressure Control In Ink-Jet Printing, U.S. Pat. No. 5,590,510 to Mochizuki et al entitled an Ink-Jet Recording Apparatus And Ink Tank Cartridge Thereof, U.S. Pat. No. 5,486,855 to Carlotta et al entitled an Apparatus For Supplying Ink To An Ink Jet Printer, U.S. Pat. No. 5,464,578 to Salteretal. entitled a Method Of making A Compact Fluid Coupler For Thermal Inkjet Print Cartridge Ink Reservoir, U.S. Pat. No. 5,459,497 to Manning et al. entitled an Ink Supply System For Continuous Ink Jet Printer, U.S. Pat. No. 5,450,112 to Scheffelin entitled a Laminated Film For Ink Reservoir, U.S. Pat. No. 5,440,333 to Sykora et al. entitled a Collapsible Ink Reservoir And Ink-Jet Cartridge With Protective Bounding Layer For The Pressure Regulator, U.S. Pat. No. 5,420,635 to Dietl et al entitled an Ink Supply System For A Thermal Ink-Jet Printer, U.S. Pat. No. 5,278,584 to Keefe et al. entitled an Ink Delivery System For An Inkjet Printhead, U.S. Pat. No. 5,233,369 to Carlotta et al. entitled a Method And Apparatus For Supplying Ink To An Ink Jet Printer, U.S. Pat. No. 5,223,860 to Loofbourow et al. entitled an Apparatus For Supplying Phase Change Ink To An Ink Jet Printer, U.S. Pat. No. 5,121,132 to Pan et al. entitled an Ink Delivery System For Printers, U.S. Pat. No. 4,937,598 to Hine et al. entitled an Ink Supply System For An Ink Jet Head, U.S. Pat. No. 4,929,963 to Balazar entitled an Ink Delivery System For Inkjet Printer, U.S. Pat. No. 4.914,453 to Kanayama et al. entitled an Ink Reservoir Of Ink Jet Printer, U.S. Pat. No. 4,899,178 to Tellier entitled a Thermal Ink Jet Printhead With Internally Fed Ink Reservoir, U.S. Pat. No. 4,824,487 to Heffernan entitled a Cleaning Of Polyurethane Foam Reservoir, U.S. Pat. No. 4,424,521 to Lewis et al. entitled an Ink Jet Apparatus And Reservoir, U.S. Pat. No. 4,119,034 to Wax entitled a Leak-proof ink Supply Reservoir, U.S. Pat. No. 4,025,928 to Hou et al. entitled a Unitary Inkjet And Reservoir, U.S. Pat. No. 4,791,439 to Guiles entitled an Ink Jet Apparatus With Improved Reservoir System For Handling Hot Melt Ink, U.S. Pat. No. 4,739,347 to Ishikawa et al. entitled an Ink Supply System For Use In An Ink-Jet Printer, U.S. Pat. No. 4,580,147 to Deyoung et al. entitled an Ink Jet Apparatus With Imprived Reservoir System For Handling Hot Melt Ink, U.S. Pat. No. 4,513,297 to Okamura entitled an Ink Jet Printer Reservoir, U.S. Pat. No. 4,511,906 to Hara entitled an Ink Liquid Reservoir In An Ink Jet System Printer, and U.S. Pat. No. 4,509,062 to Low et al. entitled an Ink Reservoir With Essentially Constant Negative Back Pressure.

SUMMARY OF THE INVENTION

Therefore, in order to overcome such drawbacks of the prior art, an objective of the present invention is to provide an inkjet print head for increasing the ink storage efficiency in the housing, and applying a uniform pressure to the ink stored, thereby minimizing the amount of ink remaining after exhaustion or full consumption.

It is another objective of the present invention to provide an inkjet print head for increasing the ink storage efficiency while reducing the amount of remaining ink in order to extend the duration of the print head, and accordingly reduce the management cost.

To accomplish the objectives of the present invention, there is provided an ink reservoir for an inkjet print head which stores ink and sprays it when electric energy is applied thereto, the reservoir comprising a housing for storing ink, a plurality of elastic pieces mounted on the top and bottom of the housing for absorbing air or ink, a plurality of supporting plates for supporting and maintaining the shape of the elastic pieces, and an elastic member attached to the supporting plates for keeping the elastic pieces spaced apart by a predetermined distance.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Hereinafter, a preferred embodiment of the present invention will be described in detail with reference to the attached drawings.

Figure 1:
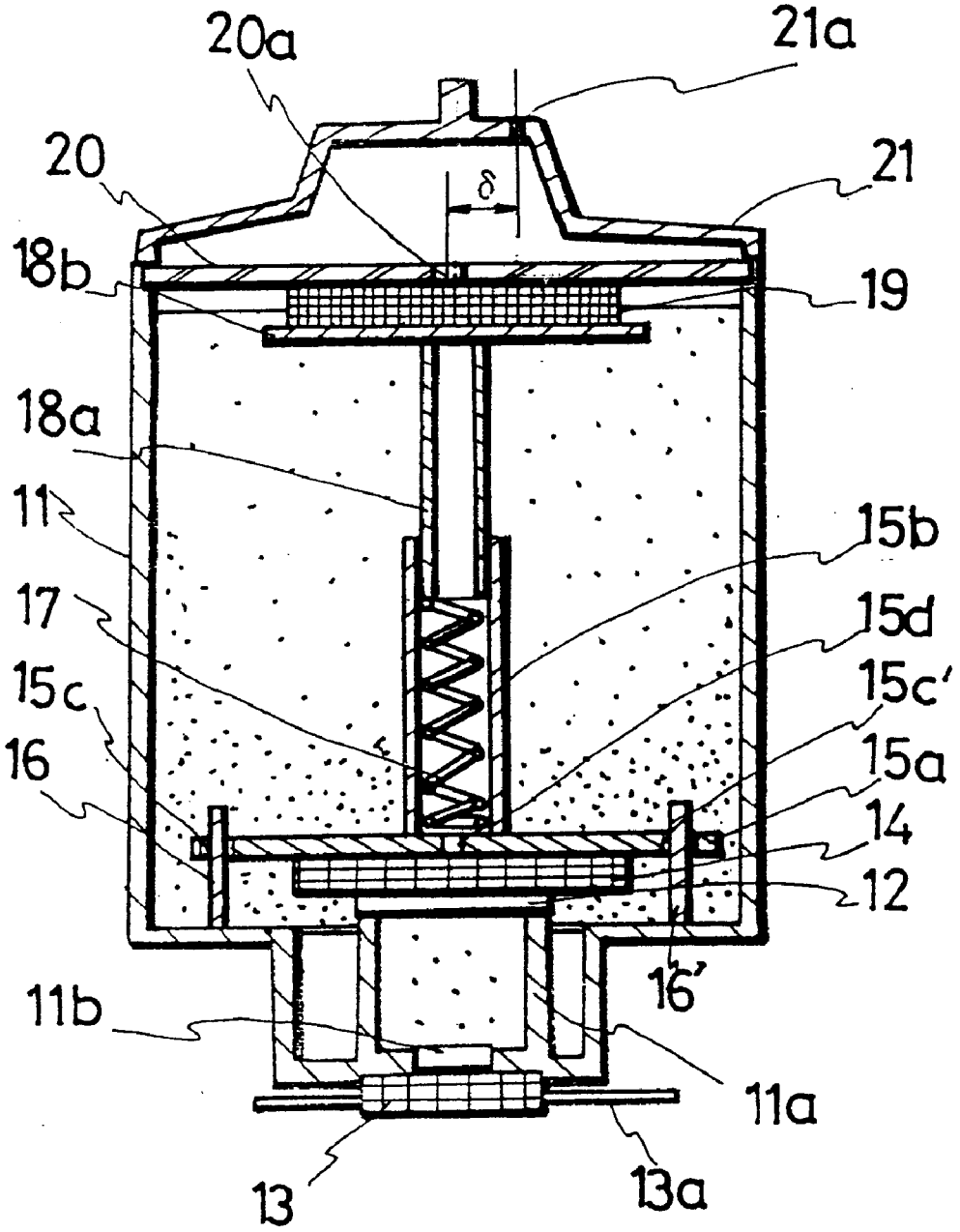
FIG. 1 is a side sectional view of a print head according to the present invention.

Referring to FIG. 1, an inkjet print head of the present invention comprises a housing 11 for storing ink, a plurality of elastic pieces 14 and 19 mounted on the top and bottom of housing 11 for absorbing air or ink, a plurality of supporting plates 15*a* and 18*b* for supporting and maintaining the shape of elastic pieces 14 and 19, and elastic members 15*b* and 18*a* attached to supporting plates 15*a* and 18*b* for keeping elastic pieces 14 and 19 spaced apart by a predetermined height.

The present invention will be explained below in more detail.

When electric energy is applied from an electric coupling device 13*a* to an ink spraying device 13, it starts to spray ink. Upon starting, an ink absorption force and negative pressure are generated within housing 11. With such absorption force and negative pressure, ink is supplied to ink spraying device 13 via ink stand pipe 11*a* and ink port 11*b*. The pressure in ink spraying device 13 is not large enough for forcible spraying. This is because the first elastic piece 14, which absorbs ink, absorbs the pressure of housing 11.

The first elastic piece 14, which absorbs pressure, is installed so as to connect to opening 15*d* formed on first supporting plate 15*a* The opening 15*d* connected to the first supporting plate 15*a* is installed so as to be positioned at the lowest height of ink stored in housing 11 in order to reduce the amount of ink remaining at full consumption. The first elastic piece 14 installed around the bottom of housing 11 absorbs ink, and has multiple void volumes (not shown) in the shape of open shells. The first elastic piece 14 stores ink after absorbing it through the small void volumes. The principle of absorbing ink through the void volumes is similar to a capillary phenomenon.

When the first elastic piece 14 absorbs ink through the void volumes according to the capillary phenomenon principle, the pressure of housing 11 decreases. When this happens, air comes in through air entrance opening 21*a* formed on housing cover 21. The incoming air is absorbed through ink injection opening 20*a* formed on ink closing cap 20. The air absorbed through ink injection opening 20*a* enters the void volumes formed on second elastic piece 19. Due to the pressure of air absorbed, the ink stored in housing 11 is subjected to a uniform pressure.

When the external air goes into housing 11 through second elastic piece 19, the negative pressure in housing 11 can be eliminated because of continuous generation of negative pressure by ink spraying device 13. The first and second elastic pieces 14 and 19 that absorb air or ink have therein a plurality of regular ink storage volumes, which are made of urethane foaming agent, with an open shell through which fluid is received mutually. The thickness falls within the range of 3–55 mm, but a range of 10–22 mm is most preferable. The space between ink closing cap 20 and housing cover 21 maintains uniform air pressure by having a regular amount of air coming through air entrance opening 21*a*.

Conversely, in the case of normal housing pressure, the ink stored in housing 11 through the void volumes should be prevented from being discharged through ink injecting opening 20*a*. For this purpose, second elastic piece 19 receives the resilient force of compression spring 17 inserted into elastic member 15*b* which serves as a first supporting rod. The resilient force of spring 17 is transmitted by the second supporting plate 18*b* via member 18*a* serving as a secured supporting rod. The second elastic piece 19 is pressed onto ink injecting opening 20*a* by second supporting plate 18*b* which receives the resilient force, so that the leakage of ink is prevented.

When the ink contained in housing 11 is exhausted through repetition of such process, ink positioned lower than first elastic piece 14 is left, and most of the ink is consumed through ink spraying device 13. Improper ink injection is interrupted in advance by having air entrance opening 21*a* and ink injection opening 20*a* not communicating but maintaining a predetermined distance δ therebetween.

An assembly procedure of the inkjet print head of the present invention will be explained below with reference of the attached drawings.

Figure 2:
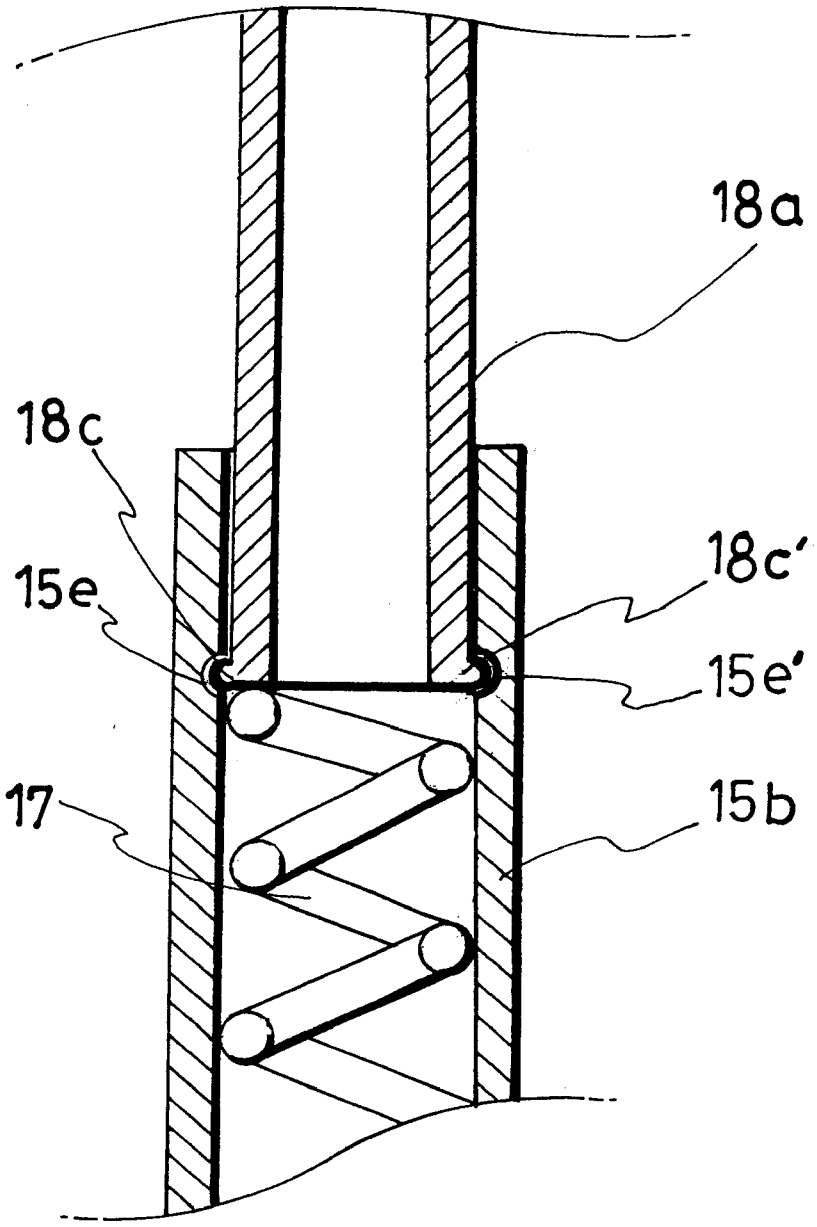
FIG. 2 is an enlarged view of the first and second supporting means shown in FIG. 1.

As shown in FIG. 2, the elastic members 15*b* and 18*a* serve as first and second supporting rods with compression spring 17. Elastic member or second supporting rod 18*a* is telescopically inserted into elastic member or first supporting rod 15*b*, and elastic member or first supporting rod 15*b* has at least one undercut 15*e*, 15*e*′ into which elastic member or second supporting rod 18*a* is fitted. In order to correspond to undercut 15*e*, 15*e*′ formed on first supporting rod 15*b*, second supporting rod 18*a* has at least one protrusion 18*c*, 18*c*′.

Figure 3:
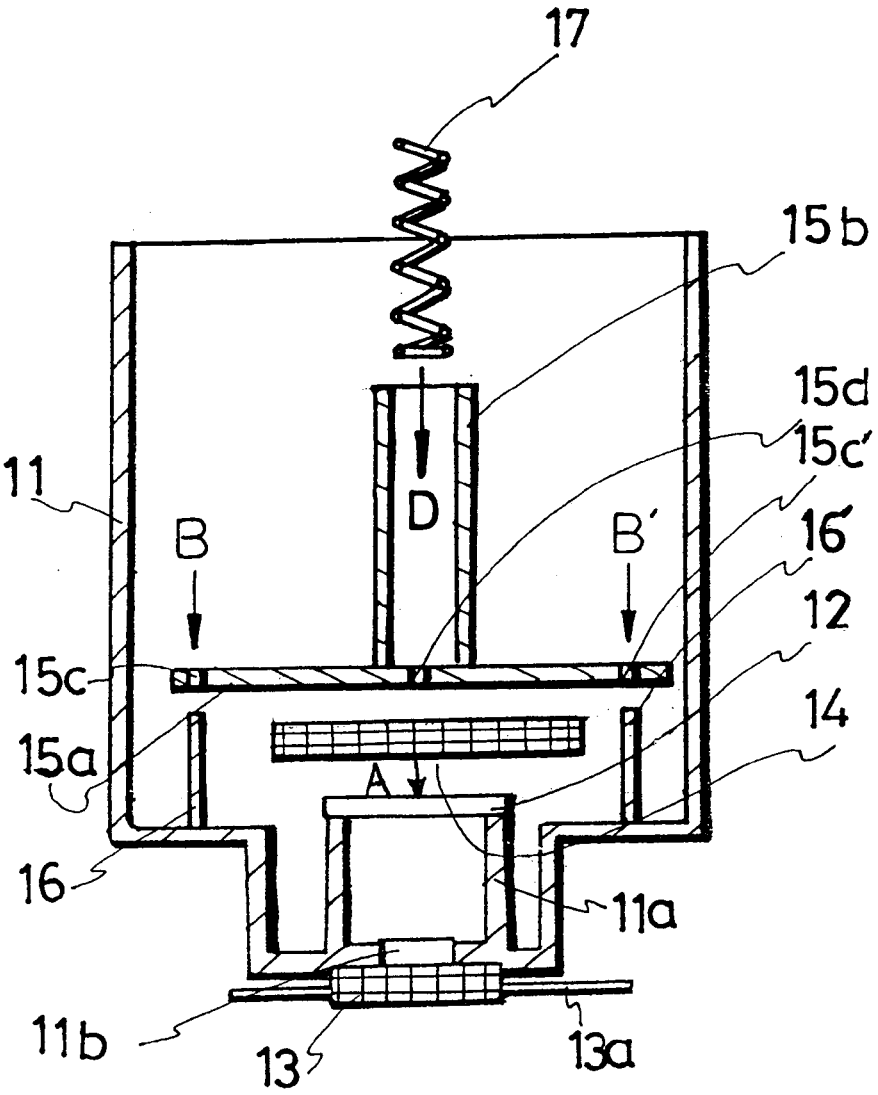
FIG. 3 is an assembly/disassembly diagram of the first elastic piece, first supporting means and compressing spring, which are all shown in FIG. 1.

With undercut 15*e*, 15*e*′ on first supporting rod 15*b* and protrusion 18*c*, 18*c*′ on second supporting rod 18*a*, compression spring 17 is mounted in a space formed in first supporting rod 15*b*, as shown in FIG. 3. A filter 12 is attached to ink port 11*b* and ink stand pipe 11*a* integrally formed in housing 11. After this procedure, first elastic piece 14 is mounted on filter 12 in the direction of arrow A. When the first elastic piece 14 is mounted on filter 12, first supporting plate 15*a* is fixed on fixing bosses 16 and 16' installed in housing 11. The first supporting plate 15*a* is fastened to fixing holes 15*c*, 15*c*′ in the direction of arrows B and B'. After this process, first supporting rod 15*b* is fixed to first supporting plate 15*a*. Then, compressing spring 17 is inserted into the internal space of first supporting rod 15*b* in the direction of arrow D.

Figure 4:
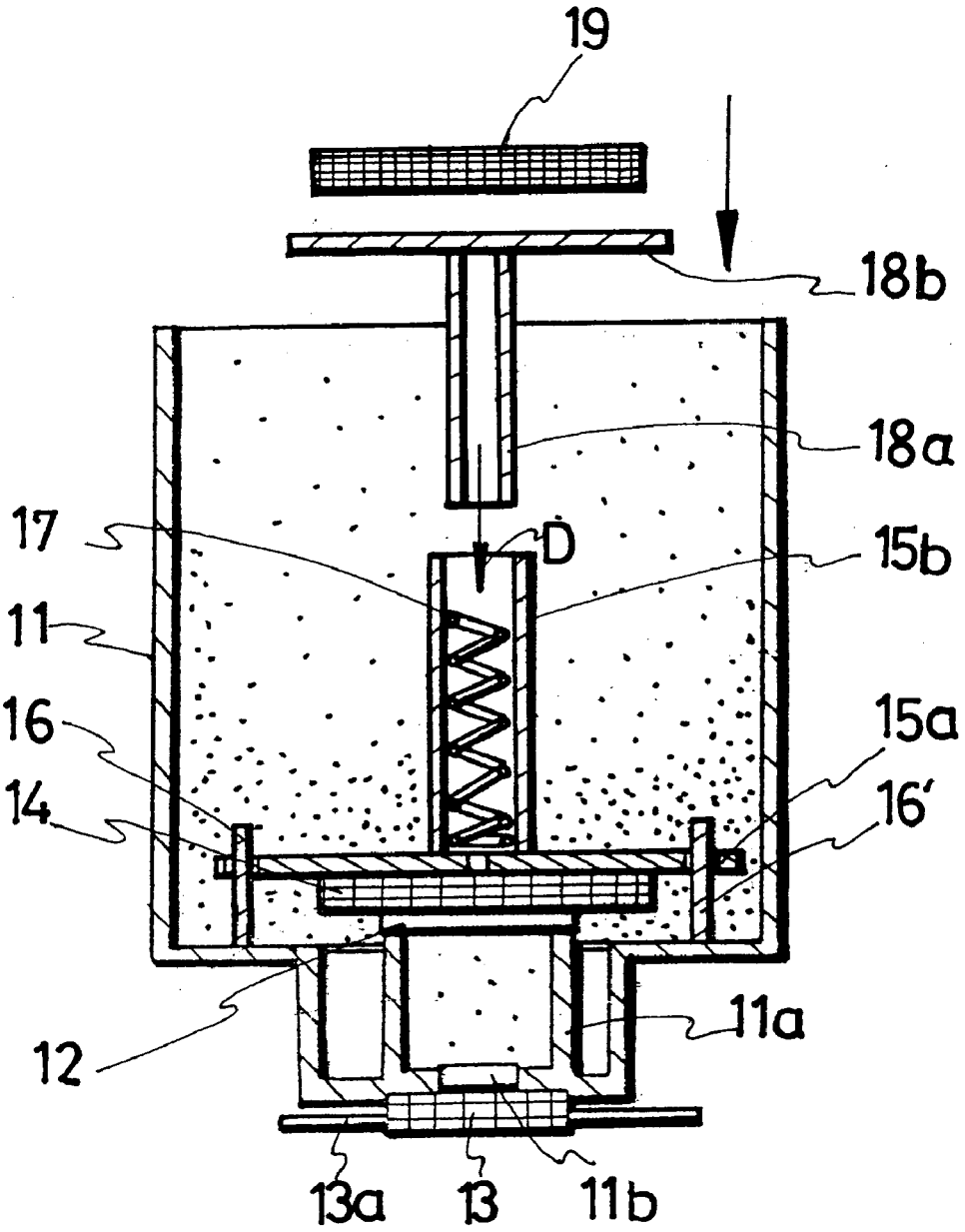
FIG. 4 is an assembly/disassembly diagram of the second supporting means and second elastic piece shown in FIG. 1.

After compression spring 17 is inserted into first supporting rod 15*b*, second supporting rod 18*a* and second elastic piece 19 are joined. Referring to FIG. 4, second supporting rod 18*a* is inserted into first supporting rod 15*b*. In order to facilitate the initial insertion of second supporting rod 18*a* into first supporting rod 15*b*, they are fitted into each other with undercuts 15*e*, 15*e*′ and protrusions 18*c* and 18*c*′ at a predetermined height. After second supporting rod 18*a* is inserted into first supporting rod 15*b*, second elastic piece 19 is mounted on second supporting plate 18*b* of second supporting means 18. Then, ink closing cap 20 is melted onto housing 11 using heat or ultrasonic wave so that they are sealed to tightly close housing 11.

Figure 5:
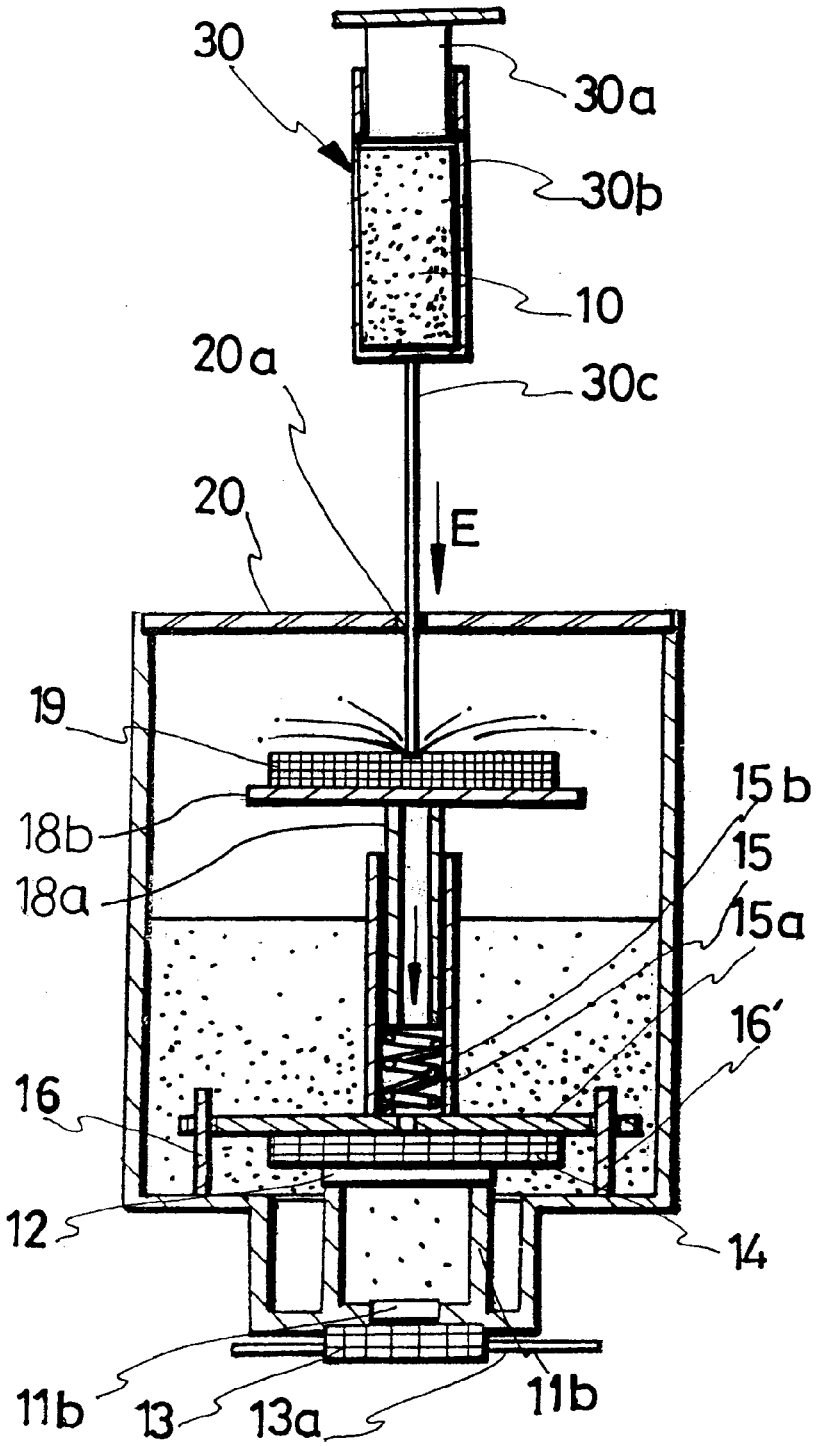
FIG. 5 is a diagram that shows a method of injecting ink in the print head shown in FIG. 1.

After the completion of the internal assembly of housing 11, ink is injected into housing 11, as shown in FIG. 5. The ink stored in ink storage cylinder 30*b* of ink injector 30 receives a predetermined pressure so that it goes into housing 11 through an injection needle 30*c*. Specifically, when a predetermined pressure is applied with ink injector 30 oriented in the direction of arrow E, second elastic piece 19 receives a pressure. This pressure applied to second elastic piece 19 is transmitted to compression spring 17 via second supporting rod 18*a*.

The compression spring 17 is pushed by this pressure. The compressed spring 17 moves second supporting rod 18*a*, which supports second elastic piece 19, in the direction of arrow E. When second supporting rod 18*a* moves, ink injecting needle 30*c* is inserted into housing 11 through ink injection opening 20*a*. Through the needle 30*c* inserted into the housing 11, ink enters housing 11. Upon the completion of ink injection into housing 11, housing cover 21 is joined with housing 11. The housing cover 21 is melted and sealed with housing 11, finishing the assembly of an inkjet print head.

It will be apparent to the reader that the foregoing description of the invention has been presented for purposes of illustration and description and for providing an understanding of the invention, and that many changes and modifications can be made without departing from the scope of the invention. It is, therefore, intended that the scope of the invention be indicated by the appended claims rather than by the foregoing description; all changes which come within the meaning and range of equivalency of the claims are therefore intended to be embraced therein.

What is claimed is:

1. An ink reservoir for an inkjet print head which stores ink and sprays the ink when an electric energy is applied thereto, said reservoir comprising:

a housing for storing the ink, said housing having a top and a bottom;

a plurality of elastic pieces mounted on the top and bottom, respectively, of the housing for absorbing at least one of air and ink;

a plurality of supporting plates connected to said elastic pieces for supporting and maintaining a shape of said elastic pieces; and an elastic member attached to the supporting plates for keeping the elastic pieces spaced apart by a predetermined distance.

2. The reservoir as claimed in claim 1, wherein said elastic pieces include a plurality of regular ink storage volumes which are made of urethane foaming agent with an open shell through which fluid is received.

3. The reservoir as claimed in claim 1, wherein said elastic pieces have a thickness of between 3 mm and 55 mm.

4. The reservoir as claimed in claim 3, wherein said elastic pieces have a thickness of between 10 mm and 20 mm.

5. The reservoir as claimed in claim 1, wherein said elastic pieces include:

a first elastic piece mounted on said housing for regularly maintaining pressure in said housing with external air entering said housing;

a second elastic piece for absorbing ink supplied at a predetermined pressure of the first elastic piece; and a filter adjacent to said second elastic piece for receiving said ink from said second elastic piece.

6. The reservoir as claimed in claim 5, wherein said housing includes a closing cap having an ink injection opening, and the second elastic piece bears against and tightly closes the ink injection opening of the closing cap due to resilience of the elastic member.

7. The reservoir as claimed in claim 1, wherein the supporting plates include a first supporting plate for supporting one of the elastic pieces mounted on the top of the housing, and a second supporting plate for supporting one of the elastic pieces mounted on the bottom of the housing.

8. An ink reservoir for an inkjet print head which stores ink and sprays the ink when an electric energy is applied thereto, said reservoir comprising:

a housing for storing the ink, said housing having a top and a bottom;

a plurality of elastic pieces mounted on the top and bottom, respectively, of the housing for absorbing at least one of air and ink;

a plurality of supporting plates connected to said elastic pieces for supporting and maintaining a shape of said elastic pieces; and an elastic member attached to the supporting plates for keeping the elastic pieces spaced apart by a predetermined distance;

wherein said elastic pieces include:

a first elastic piece mounted on said housing for regularly maintaining pressure in said housing with external air entering said housing;

a second elastic piece for absorbing ink supplied at a predetermined pressure of the first elastic piece; and a filter adjacent to said second elastic piece for receiving said ink from said second elastic piece;

wherein the first elastic piece transmits a resilient force by means of one of the supporting plates and the elastic member to the filter.

9. An ink reservoir for an inkjet print head which stores ink and sprays the ink when an electric energy is applied thereto, said reservoir comprising:

a housing for storing the ink, said housing having a top and a bottom;

a plurality of elastic pieces mounted on the top and bottom, respectively, of the housing for absorbing at least one of air and ink;

a plurality of supporting plates connected to said elastic pieces for supporting and maintaining a shape of said elastic pieces; and an elastic member attached to the supporting plates for keeping the elastic pieces spaced apart by a predetermined distance;

wherein one of the supporting plates is mounted on the top of the housing and another of the supporting plates is mounted on the bottom of the housing, and the elastic member comprises:

a first supporting rod attached the supporting plate mounted on the bottom of the housing;

a second supporting rod attached to the supporting plate mounted on the top of the housing, said first and second supporting rods being telescopically interconnected; and a compression spring inserted into the first supporting rod for providing a predetermined resilient force to the second supporting rod.

10. The reservoir as claimed in claim 9, wherein the first supporting rod has at least one undercut to which the second supporting rod is hooked.

11. The reservoir as claimed in claim 10, wherein at least one protrusion is provided on the second supporting rod.

12. The reservoir as claimed in claim 10, wherein the second supporting rod has at least one protrusion which is fitted into said at least one undercut formed on the first supporting rod.

13. A reservoir for an inkjet print head which stores ink and sprays the ink when an electric energy is applied thereto, said reservoir comprising:

housing means for storing the ink;

elastic means mounted on a top and a bottom, respectively, of said housing means for observing at least one of air and ink;

supporting plate means associated with said elastic means for supporting and maintaining a shape of said elastic means; and elastic member means attached to said supporting plate means for keeping said elastic means mounted at said top of said housing means spaced apart from said elastic means mounted at said bottom of said housing means by a predetermined distance.

14. The reservoir as claimed in claim 13, wherein said elastic means comprises a first elastic piece mounted on the top of the housing means and a second elastic piece mounted on the bottom of the housing means.

15. The reservoir as claimed in claim 14, wherein said first and second elastic pieces include a plurality of regular ink storage volumes made of urethane foaming agent with an open shell through which fluid is received.

16. The reservoir as claimed in claim 13, wherein said elastic means includes a plurality of regular ink storage volumes made of urethane foaming agent with an open shell through which fluid is received.

17. The reservoir as claimed in claim 13, wherein said elastic means comprises a plurality of elastic pieces, each having a thickness of between 3 mm and 55 mm.

18. The reservoir as claimed in claim 17, wherein said elastic means comprises a plurality of elastic pieces, each having a thickness of between 10 mm and 20 mm.

19. The reservoir as claimed in claim 13, wherein said elastic means comprises:

a first elastic piece mounted on said housing means for regularly maintaining pressure in said housing means with external air entering said housing means; and a second elastic piece for absorbing ink supplied at a predetermined pressure.

20. The reservoir as claimed in claim 19, wherein said first elastic piece is disposed at the top of said housing means and said second elastic piece is disposed at the bottom of said housing means.

21. The reservoir as claimed in claim 20, further comprising a filter disposed adjacent to said second elastic piece.

22. The reservoir as claimed in claim 19, further comprising a filter disposed adjacent to said elastic means at the bottom of said housing means.

23. The reservoir as claimed in claim 19, further comprising a closing cap having an ink injection opening formed therein, said closing cap being disposed adjacent to said elastic means at said top of said housing means, wherein said elastic means tightly closes said ink injection opening of said closing cap due to resilience of said elastic member means.

24. The reservoir as claimed in claim 13, further comprising a closing cap having an ink injection opening formed therein, said closing cap being disposed adjacent to said elastic means at said top of said housing means, wherein said elastic means tightly closes said ink injection opening of said closing cap due to resilience of said elastic member means.

25. The reservoir as claimed in claim 13, wherein said supporting means includes a first supporting plate for supporting said elastic means mounted at the top of said housing means, and a second supporting plate for supporting said elastic means mounted at said bottom of said housing means.

26. The reservoir as claimed in claim 13, wherein said elastic member means comprises a first supporting rod attached to said supporting means at the top of said housing means;

a second supporting rod attached to said supporting means at the bottom of said housing means; and a compression spring inserted into said second supporting rod for providing resilient support to said first supporting rod;

wherein said first supporting rod is telescopically inserted into said second supporting rod.

27. The reservoir as claimed in claim 26, wherein one of said first and second supporting rods has at least one undercut to which another of said first and second supporting rods is hooked.

28. The reservoir as claimed in claim 27, wherein said another of said first and second supporting rods has at least one protrusion which fits into said at least one undercut.

29. A reservoir for an inkjet print head which stores ink and sprays the ink when an electric energy is applied thereto, said reservoir comprising:

housing means for storing the ink;

elastic means mounted on a top and a bottom, respectively, of said housing means for observing at least one of air and ink;

supporting plate means associated with said elastic means for supporting and maintaining a shape of said elastic means; and elastic member means attached to said supporting plate means for keeping said elastic means mounted at said top of said housing means spaced apart from said elastic means mounted at said bottom of said housing means by a predetermined distance;

wherein said elastic means comprises:

a first elastic piece mounted on said housing means for regularly maintaining pressure in said housing means with external air entering said housing means; and a second elastic piece for absorbing ink supplied at a predetermined pressure;

said reservoir further comprising a filter disposed adjacent to said elastic means at the bottom of said housing means;

wherein said elastic means transmits a resilient force by means of said elastic member means to said filter.

30. A reservoir for an inkjet print head which stores ink and sprays the ink when an electric energy is applied thereto, said reservoir comprising:

housing means for storing the ink;

elastic means mounted on a top and a bottom, respectively, of said housing means for observing at least one of air and ink;

supporting plate means associated with said elastic means for supporting and maintaining a shape of said elastic means; and elastic member means attached to said supporting plate means for keeping said elastic means mounted at said top of said housing means spaced apart from said elastic means mounted at said bottom of said housing means by a predetermined distance;

wherein said supporting means includes a first supporting plate for supporting said elastic means mounted at the top of said housing means, and a second supporting plate for supporting said elastic means mounted at said bottom of said housing means;

wherein said elastic member means comprises:

a first supporting rod attached to said first supporting plate;

a second supporting rod attached to said second supporting plate; and a compression spring inserted into said second supporting rod for providing resilient support to said first supporting rod;

wherein said first supporting rod is inserted telescopically into said second supporting rod.

* * * * *